US007358934B2

(12) United States Patent
Watanabe et al.

(10) Patent No.: US 7,358,934 B2
(45) Date of Patent: Apr. 15, 2008

(54) FIELD EMISSION DISPLAY APPARATUS WITH IMPROVED WHITE BALANCE

(75) Inventors: Toshimitsu Watanabe, Yokohama (JP); Go Uchida, Mobara (JP); Masaki Nishikawa, Chiba (JP); Tetsu Ohishi, Hiratsuka (JP)

(73) Assignee: Hitachi, Ltd., Tokyo (JP)

( * ) Notice: Subject to any disclaimer, the term of this patent is extended or adjusted under 35 U.S.C. 154(b) by 251 days.

(21) Appl. No.: 11/213,144

(22) Filed: Aug. 25, 2005

(65) Prior Publication Data

US 2006/0050039 A1 Mar. 9, 2006

(30) Foreign Application Priority Data

Sep. 3, 2004 (JP) ..... 2004-256415

(51) Int. Cl.
*G09G 3/20* (2006.01)

(52) U.S. Cl. ..... 345/75.2; 345/77; 345/690; 345/204; 315/169.1; 315/169.3; 313/496

(58) Field of Classification Search ..... 345/75.2, 345/77, 100, 204, 589, 690, 698, 55, 206, 345/84; 315/169.1–169.3; 313/497, 504, 313/496, 503

See application file for complete search history.

(56) References Cited

U.S. PATENT DOCUMENTS 5,529,524 A * 6/1996 Jones ..... 445/24
5,898,415 A * 4/1999 Hansen et al. ..... 345/74.1
5,926,239 A * 7/1999 Kumar et al. ..... 349/69
6,608,620 B1 * 8/2003 Suzuki et al. ..... 345/204
6,819,041 B2 * 11/2004 Kajiwara ..... 313/496
6,841,946 B2 * 1/2005 Suzuki et al. ..... 315/169.1
6,873,115 B2 * 3/2005 Sagawa et al. ..... 315/169.1

FOREIGN PATENT DOCUMENTS

JP 2002-063847 2/2002
JP 2003-249361 9/2003

* cited by examiner

*Primary Examiner*—Haissa Philogene
(74) *Attorney, Agent, or Firm*—Townsend and Townsend and Crew LLP

(57) ABSTRACT

In an FED (Field Emission Display), lowering of a color temperature is suppressed which is caused by that light emission luminance of respective color phosphors is different from each other so as to achieve a better white balance. A display apparatus is equipped with a cathode substrate containing a plurality of electron emitter elements, and an anode substrate. The anode substrate is arranged opposite to the cathode substrate, and contains three colors of red, green, blue phosphors which are excited by electrons emitted from the electron emitter elements so as to emit light. Then, an area of either the red phosphor or an area of the blue phosphor is made smaller than an area of the green phosphor.

15 Claims, 6 Drawing Sheets

FIELD EMISSION DISPLAY APPARATUS WITH IMPROVED WHITE BALANCE

INCORPORATION BY REFERENCE

The present application claims priority from Japanese application JP2004-256415 filed on Sep. 3, 2004, the content of which is hereby incorporated by reference into this application.

BACKGROUND OF THE INVENTION

1. Field of the Invention

This invention is relates to a display apparatus such as a field emission display (will be referred to as "FED" hereinafter) constituted to be capable of achieving a superior white balance.

2. Description of the Related Art

Among flat panel type picture display apparatus in which red phosphors, green phosphors, and blue phosphors are separately excited so as to emit (glow) light and to produce images, there are some cases that since light emission luminance of the respective color phosphors differs from each other, superior white balances cannot be achieved. Conventional technical ideas capable of achieving superior white balances in such picture display apparatus have been described in, for instance, JP-A-2002-63847 (will be referred to as "publication 1" hereinafter), and JP-A-2003-249361 (will be referred to as "publication 2" hereinafter). The publication 1 discloses that in a plasma display panel (will be referred to as "PDP" hereinafter), since luminance of a blue phosphor is relatively lower than luminance of a red phosphor and of a green phosphor, an area of the blue phosphor is made larger than areas of the two remaining phosphors. Similarly, the publication 2 discloses that in an organic EL (Electro-Luminescence), since luminance of a blue phosphor is relatively lower than luminance of a red phosphor and of a green phosphor, an area of the blue phosphor is made large than areas of the two remaining phosphors.

SUMMARY OF THE INVENTION

In a PDP, phosphors are excited to emit light by ultraviolet rays generated from plasma discharging operations, whereas in an FED, phosphors are excited to emit light by electron beams from electron radiating elements. In other words, as to PDPs and FEDs, the methods for exciting the phosphors are different from each other, and further, sorts and materials of the phosphors used therein are different from each other. As the phosphors used in PDPs, for example, red phosphor: (Y, Gd)$BO_3$:Eu, green phosphor: $ZnSiO_4$:Mn, and blue phosphor: $BaMgAl_{10}O_{17}$:Eu are used. When a white color is displayed in a PDP, in the case that luminance of a green color is employed as a reference, luminance of a blue color is relatively low. On the other hand, as the phosphors used in FEDs, for instance, red phosphor: $Y_2O_3$:Eu, green phosphor: $Y_2SiO_5$:Tb, and blue phosphor: ZnS:Ag,Cl are used. When a white color is displayed in an FED, in such a case that luminance of a green color is employed as a reference, both luminance of a red color and luminance of a blue color are relatively high. As a consequence, even when the technical idea described in the publication 1 is applied to FEDs, it is practically difficult to achieve superior white balances.

The above-described publication 2 discloses such a technical means that the area of the blue phosphor is made larger than the areas of the remaining two phosphors may be applied not only to organic ELs, but also to FEDs (refer to paragraph number [0022] in publication 2). However, as explained above, in the phosphors used in the FEDs, the luminance of the green color is lower than the luminance of the red color and the luminance of the blue color. As a result, even when this technical means is applied to FEDs, it is practically difficult to obtain better white balances.

This invention is provided to solve the above-explained problem, and therefore, has an object to provide a technical idea capable of achieving a superior white balance in FEDs.

A first feature of a picture display apparatus, according to this invention, is realized by that an area (namely, area of light emitting region of phosphor) of either a red phosphor or a blue phosphor is made larger than an area of a green phosphor. In the case that the area of either the red phosphor or the blue phosphor is made smaller than the area of the green phosphor, a shield portion may be formed at a substantially center portion of a region where either the red phosphor or the blue phosphor is formed, while the shield portion shields a portion of light emitted from the red phosphor, or the blue phosphor.

Also, a second feature of the picture display apparatus according to this invention is that an area of an electron emission element corresponding to the green phosphor is larger than an area of an electron emission element corresponding to either the red phosphor or the blue phosphor.

Also, a third feature of the picture display apparatus according to this invention is that a gain of a drive signal which is supplied to the electron emission element corresponding to the green phosphor is higher than a gain of a drive signal which is supplied to an electron emission element corresponding to either the red phosphor or the blue phosphor.

Other objects, features and advantages of the invention will become apparent from the following description of the embodiments of the invention taken in conjunction with the accompanying drawings.

DETAILED DESCRIPTION OF THE EMBODIMENTS

Figure 1:
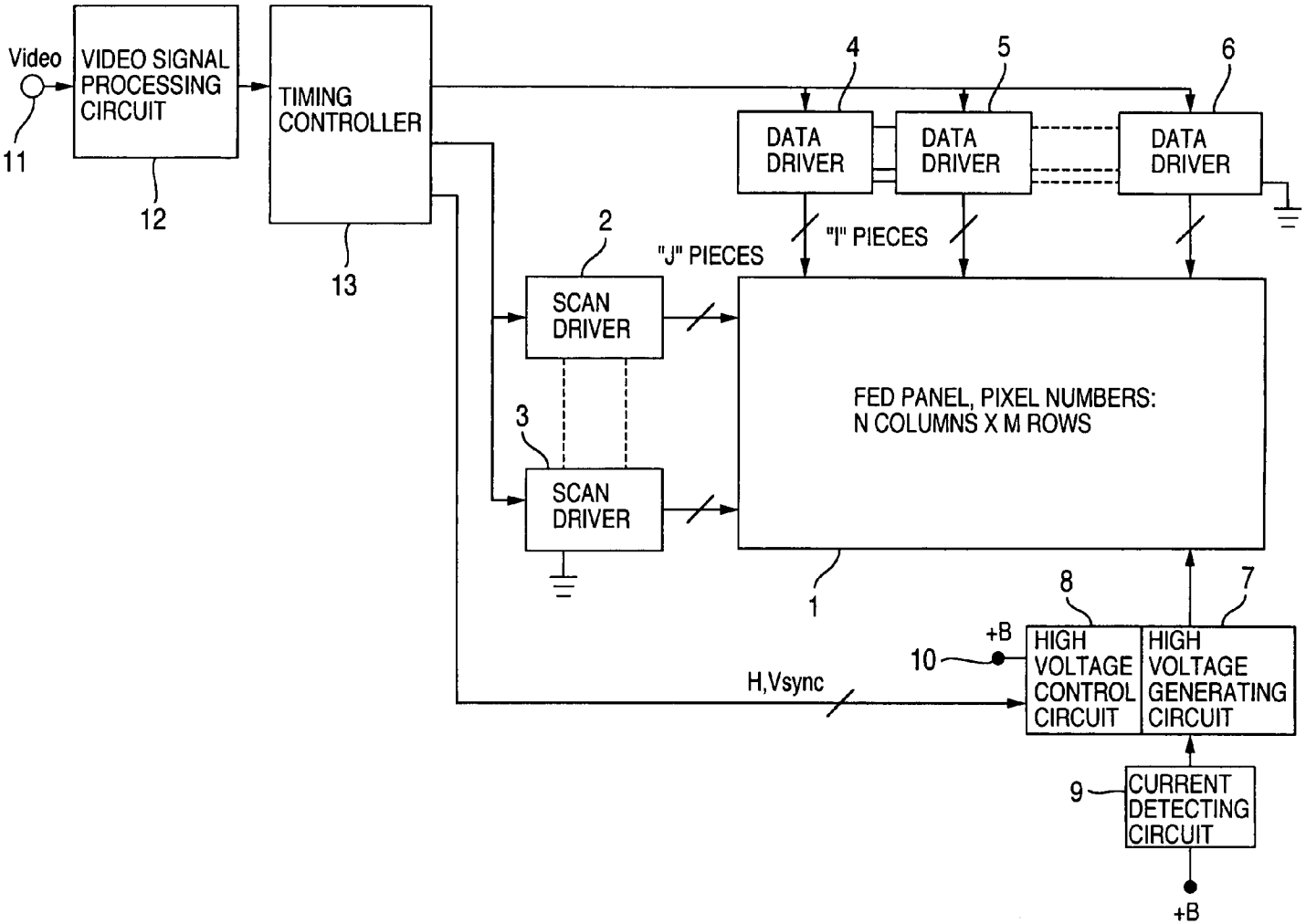
FIG. 1 is a schematic diagram for representing a system arrangement of an FED to which this invention is applied.

Referring now to drawings, preferred embodiments of this invention will be described. FIG. 1 is a schematic diagram for showing a system arrangement of an FED to which this invention is applied.

An FED (Field Emission Display) panel 1 corresponds to a passive matrix type picture display apparatus. As will be explained later, the FED panel 1 has contained a plurality of data lines, a plurality of scanning electrode lines, and a plurality of electron emitter elements connected to intersecting portions between the data lines and the scanning electrode lines. A scan driver 2 and another scan driver 3 are connected to the scanning electrode lines, whereas data drivers 4 to 6 are connected to the data lines. Assuming now that a horizontal pixel number of the FED panel 1 is equal to "n" and a vertical pixel number thereof is equal to "m", when such an LSI (Large-Scale Integration) that an output number of data driver is equal to "i" is used, "n/i" pieces of the data drivers are required. Also, when such an LSI that an output number of a scan driver is equal to "j" is employed, "m/j" pieces of the scan drivers are required. Although 3 pieces of the data drivers 4 to 6 and 2 pieces of the scan drivers are employed in this embodiment for the sake of simple explanation, larger numbers of drivers than the above-described numbers are used in an actual case. Both a high voltage generating circuit 7 and a high voltage control circuit 8 are connected to an anode terminal of the FED panel 1. A power supply voltage is applied from a power supply terminal 10 to the high voltage control circuit 8. The scan drivers 2 and 3, the data drivers 4 to 6, and the high voltage control circuit 8 are controlled in response to a signal supplied from a timing control circuit 13. Next, a description is made of operations of the respective circuit units.

A picture signal inputted from a video signal terminal 11 is processed by a video signal processing circuit 12 by performing various sorts of adjusting operations such as an amplitude adjustment, a black level control, and a color hue control, and then, the processed picture signal is entered to a timing controller 13. The timing controller 13 transmits timing signals and picture data with respect to the scan drivers 2 and 3, the data drivers 4 to 6, and the high voltage control circuit 8, respectively, based upon the picture signal adjusted by the video signal processing circuit 12, and both a horizontal synchronization (horizontal sync) signal and a vertical synchronization (vertical sync) signal which are entered in combination with the picture signal, while the timing signals are optimized so as to display a picture on the display screen of the FED panel 1.

The data drivers 4 to 6 hold one-line picture data of the FED panel 1 during one horizontal period, and rewrites the picture data every time one horizontal period elapses in synchronization with the horizontal sync timing signal supplied from the timing controller 13. Then, the one-line picture data held in the data drivers 4 to 6 are converted into analog signals by D/A converters contained in the data drivers 4 to 6, and the analog signals are supplied from the data drivers 4 to 6 to the respective data lines as drive signals which are used so as to drive electron emitter elements. On the other hand, the scan drivers 2 and 3 sequentially select the scanning electrode lines of the FED panel 1 every one row (otherwise, several rows) along the vertical direction. A scanning line electrode is selected by applying, for example, a selecting voltage of 5 volts with respect to a certain scanning electrode line. When a scanning line electrode is not selected, for instance, a voltage of 0 volt is applied to the scanning electrode line. Since the above-described selecting voltage is applied in such a manner that this selecting voltage is sequentially applied to the scanning line electrodes every one row (otherwise several rows) from the upper portion in response to the horizontal synchronization timing signal from the timing controller 13.

When a selecting voltage is applied to a certain scanning electrode line, electrons are emitted from electron emitter elements of one row which are connected to this scanning line electrode, these electrons are emitted in response to potential differences between this selecting voltage and the drive signals supplied from the data drivers 4 to 6.

A high voltage (namely, anode voltage) of several KVs is applied from the high voltage generating circuit 7 to an anode terminal of the FED panel 1. The electrons emitted from the electron emitter elements are accelerated by this anode voltage, and then, the accelerated electrodes collide with phosphors contained in the FED panel 1 which are provided in correspondence with the electron emitter elements so as to excite the phosphors. As a result, the phosphors for one row emit light, so that a picture for one horizontal line is displayed on the display screen of the FED panel 1. When all of the scanning line electrodes are sequentially selected within one frame period by the scan drivers 2 and 3, a picture for one frame is displayed on the display screen. In the case that a picture displayed on the FED panel 1 is bright, a load current from the high voltage generating circuit 7 is increased, whereas in the case that a picture displayed on the FED panel 1 is dark, a load current from the high voltage generating circuit 7 is decreased. Although the voltage value of the high voltage generating circuit 7 is lowered in connection with the increase of the load current, this voltage value may be kept constant by detecting this load current by a current detecting circuit 9 so as to feed the detected load current back to the high voltage control circuit 8 in a feedback control operation. As a result, the high voltage stabilizing control operation may be carried out.

Next, a detailed description is made of respective embodiment modes of the present invention. An explanation is made in such a case that an HIM (Metal Insulator Metal) type electron emission element is employed as the above-described electron emission element.

Embodiment 1

Figure 2:
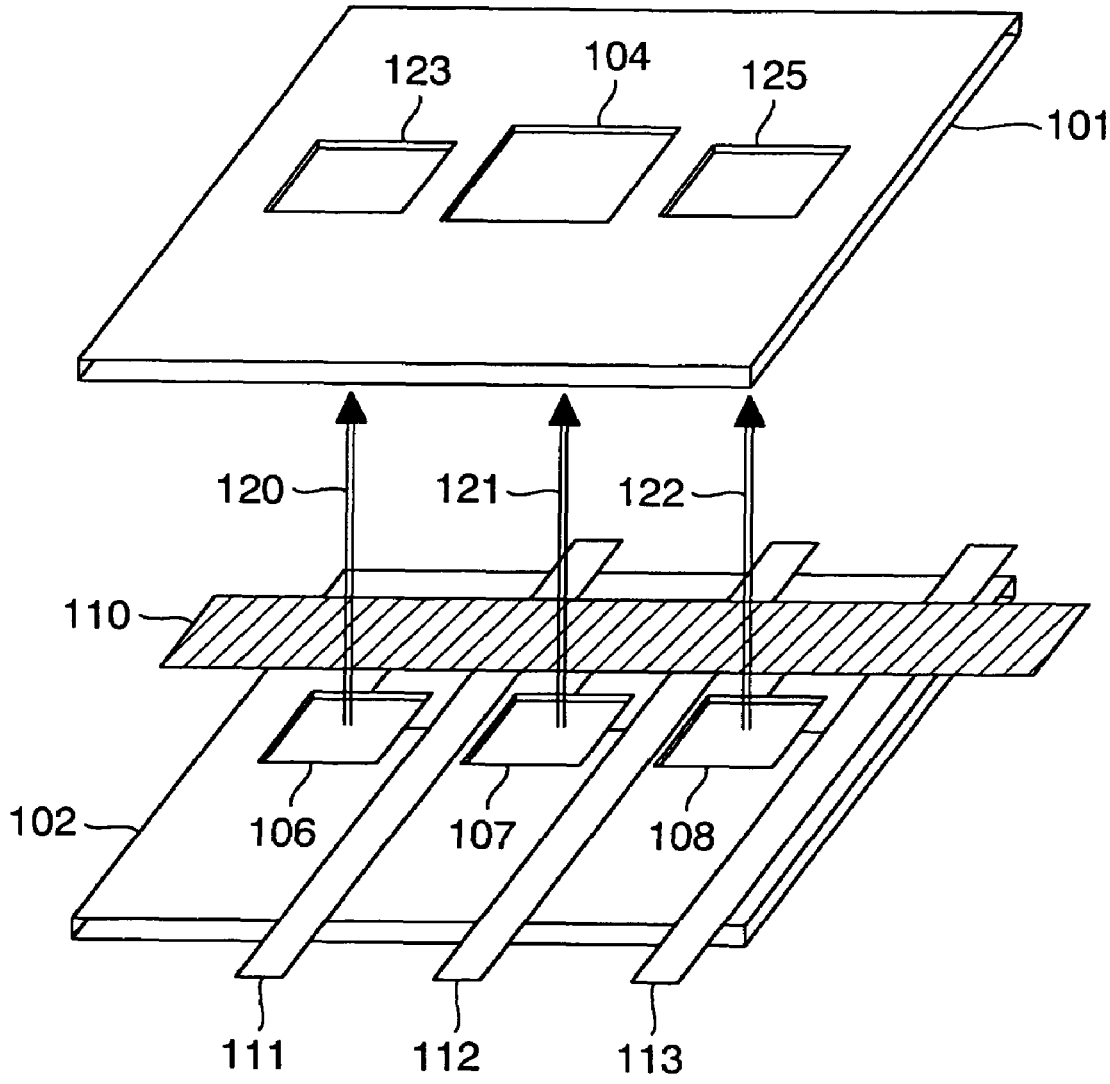
FIG. 2 is a diagram for illustratively showing an internal structure of an FED panel according to a first embodiment of this invention.

A first embodiment of this invention will now be described with reference to FIG. 2. FIG. 2 shows an internal structure of the FED panel 1, and schematically indicates respective pixels of RGB colors. While the FED panel 1 is equipped with an anode plate 101 and a cathode plate 102, a red phosphor 123, a green phosphor 104, and a blue phosphor 125 are formed on the anode plate 101. The anode plate 101 corresponds to a second substrate having a light transmission characteristic such as glass. The cathode plate 102 corresponds to a first substrate. Both an area (light emitting region) of the red phosphor 123 and an area (light emitting region) of the blue phosphor 125 are made smaller than an area (light emitting region) of the green phosphor 104. In the cathode plate 102, electron sources 106 to 108 functioning as the electron emitter elements are formed in correspondence with the red phosphor 123, the green phosphor 104, and the blue phosphor 125. A common scanning electrode line 110, and independent data lines 111 to 113 are connected to the electron sources 106 to 108. The electron sources 106 to 108 emit electron beams 120 to 122 which own strengths in response to selection time of a selected scanning line (namely, scanning line electrode to which selection voltage is applied), and voltage values of drive voltages which are applied to the data lines 111 to 113.

In the first embodiment, it is so assumed that as to the above-explained phosphors 123, 104, and 125, the same phosphors as those employed in a projection type cathode-ray tube and the like are used, for instance, $Y_2O_3$:Eu is employed as the red phosphor 123; $Y_2SiO_5$:Tb is employed as the green phosphor 104; and ZnS:Ag, Cl is employed as the blue phosphor 125. In this case, both light emission intensity of the red phosphor 123 and light emission intensity of the blue phosphor 125 become relatively high (namely, light emission intensity of green phosphor 104 becomes relatively lower than light emission intensity of both red phosphor 123 and blue phosphor 125). As a consequence, in such a case that the areas as to the red phosphor 123, the green phosphor 104, and the blue phosphor 125 are equal to each other, in order that a white color picture is displayed on the display screen of the FED panel 1, even when the levels of the drive voltages for the respective electron sources 106 to 108 are set to be equal to each other and the intensity of the respective electron beams 120 to 122 generated from the respective electron sources 106 to 108 is set to be substantially equal to each other, the displayed picture becomes magentish white. At this time, a color temperature of the displayed picture is nearly equal to 4,500 K, namely is lower than 9,300 K which corresponds to the color temperature of the standard white color of the NTSC system. In other words, in the FED using the above-explained phosphors, since the light emission luminance characteristics of the respective phosphors are different from each other, even when the amounts of the electron beams irradiated to the respective phosphors are made equal to each other, a white color having a high color temperature cannot be obtained, but also a superior white balance cannot be achieved.

In the first embodiment mode, in order that a superior white balance may be achieved and a high color temperature may be obtained in the FED having the above-described structure, as indicated in FIG. 2, both an area (namely, light emitting region) of the red phosphor 123 and an area (namely, light emitting region) of the blue phosphor 125 are made smaller than an area (light emitting region) of the green phosphor 104. Also, in the first embodiment mode, while the light emitting regions of the respective phosphors 123, 104, 125 own rectangular shapes, the dimensions of the long edges of these rectangular shapes are made short, so that the area of the green phosphor 104 may be made smaller than the area of the red phosphor 123 and the area of the blue phosphor 125. Since the FED is constituted in the above-explained manner, both the light emitting regions of the red phosphor 123 and of the blue phosphor 125 become smaller than the light emitting region of the green phosphor 104, so that the light emitting amounts of both the red phosphor 123 and the blue phosphor 125 can be reduced. As to the areas of both the red phosphor and the blue phosphor, the following area relationships are preferable. That is, the area of the red phosphor 123 is 0.85 to 0.9 times larger than the area of the green phosphor 104, and the area of the blue phosphor 125 is 0.9 to 0.95 times larger than the area of the green phosphor 104.

Figure 6:
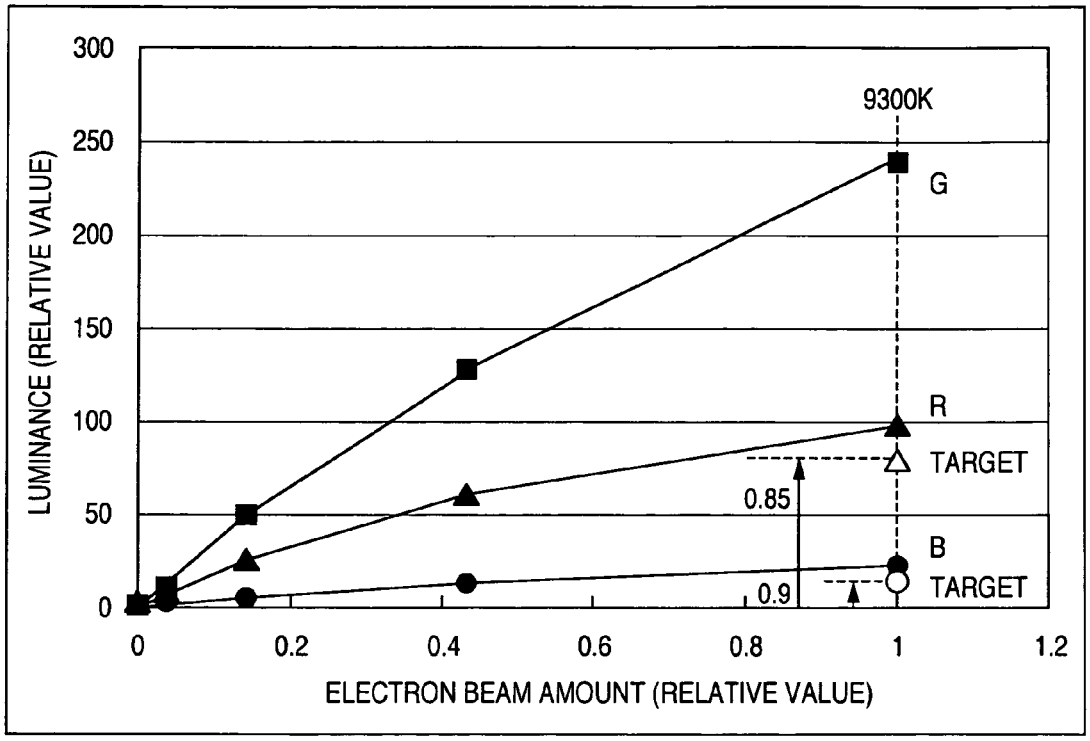
FIG. 6 is a diagram for graphically representing light emission luminance characteristics as to respective color phosphors.

A numeral value range related to a ratio of the area of the red phosphor 123 to the area of the green phosphor 104, and another numeral value range related to a ratio of the area of the blue phosphor 125 to the area of the green phosphor 104 are conducted from the light emission luminance characteristics of the respective phosphors, which could be obtained by experiments made by the inventors of this invention. FIG. 6 graphically represents these light emission luminance characteristics of the respective phosphors. In FIG. 6, a black rectangular symbol shows a luminance characteristic (relative value) of the green phosphor 104 with respect to an electron beam amount (relative value) from an electron source; a black triangular symbol shows a luminance characteristic (relative value) of the red phosphor 123 with respect to an electron beam amount (relative value) from an electron source; and a black circular symbol shows a luminance characteristic (relative value) of the blue phosphor 125 with respect to an electron beam amount (relative value) from an electron source.

As indicated in FIG. 6, in such a case that a white color is displayed when a relative value of an electron beam amount becomes 1.0 (namely, approximately maximum value), when the luminance of the red phosphor 123 corresponds to a value indicated by a white triangular symbol and the luminance of the blue phosphor 125 corresponds to a value indicated by a white circular symbol, then a color temperature of 9,300 K is obtained. However, as indicated by the black triangular symbol, the actual luminance of the red phosphor 123 at the relative value (1.0) of the electron beam amount is higher than a target value (white triangular symbol) of the luminance of the red phosphor 123. Further, as represented by the black circular symbol, the actual luminance of the blue phosphor 125 is higher than a target value (white circular symbol) of the luminance of the blue phosphor 125. In this case, as previously explained, the displayed picture becomes magentish white. In such a case that the relative value of the electron beam amount is equal to 1.0 and the color temperature of 9,300 K is obtained, a ratio of the target luminance value (while triangular symbol) of the red phosphor 123 to the actual luminance value (black triangular symbol) thereof is approximately 0.85, and further, a ratio of the target luminance value (white circular symbol) of the blue phosphor 125 to the actual luminance value (black circular symbol) is approximately 0.9. As a consequence, when an area of the red phosphor 123 is approximately 0.85 times larger than an area of the green phosphor 104, and also, an area of the blue phosphor 125 is approximately 0.9 times larger than the area of the green phosphor 104, then light emission luminance from the red phosphor 123 and the green phosphor 104 are suppressed. In other words, the light emission luminance from the red phosphor 123 is suppressed by 0.85 times, as compared with that of such a case that the area of the red phosphor 123 is made equal to the area of the green phosphor 104. Also, the light emission luminance from the blue phosphor 125 is suppressed by 0.90 times, as compares with that of such a case that the area of the blue phosphor 125 is made equal to the area of the green phosphor 104.

In accordance with such a structure, even when the amounts of the respective electron beams 120 to 122 emitted from the electron sources 106 to 108 are made nearly equal to each other, it is possible to obtain the white color having the color temperature of 9,300 K equal to the standard white color. Similarly, when an area of the red phosphor 123 is approximately 0.9 times larger than an area of the green phosphor 104, and also, an area of the blue phosphor 125 is approximately 0.92 to 0.95 times larger than the area of the green phosphor 104, then such a white color having a color temperature approximated to 6,500 K is obtained. As previously explained, in accordance with the first embodiment mode, it is possible to prevent the deterioration of the white balance due to the difference in the light emission luminance characteristics of the respective RGB phosphors 123, 104, 125. Furthermore, even when the driving voltages having the substantially same levels are applied to the electronic sources 106 to 108 corresponding to the RGB phosphors 123, 104, 125, both the white color having the high color temperature and the superior white balance can be obtained.

Embodiment 2

Figure 3:
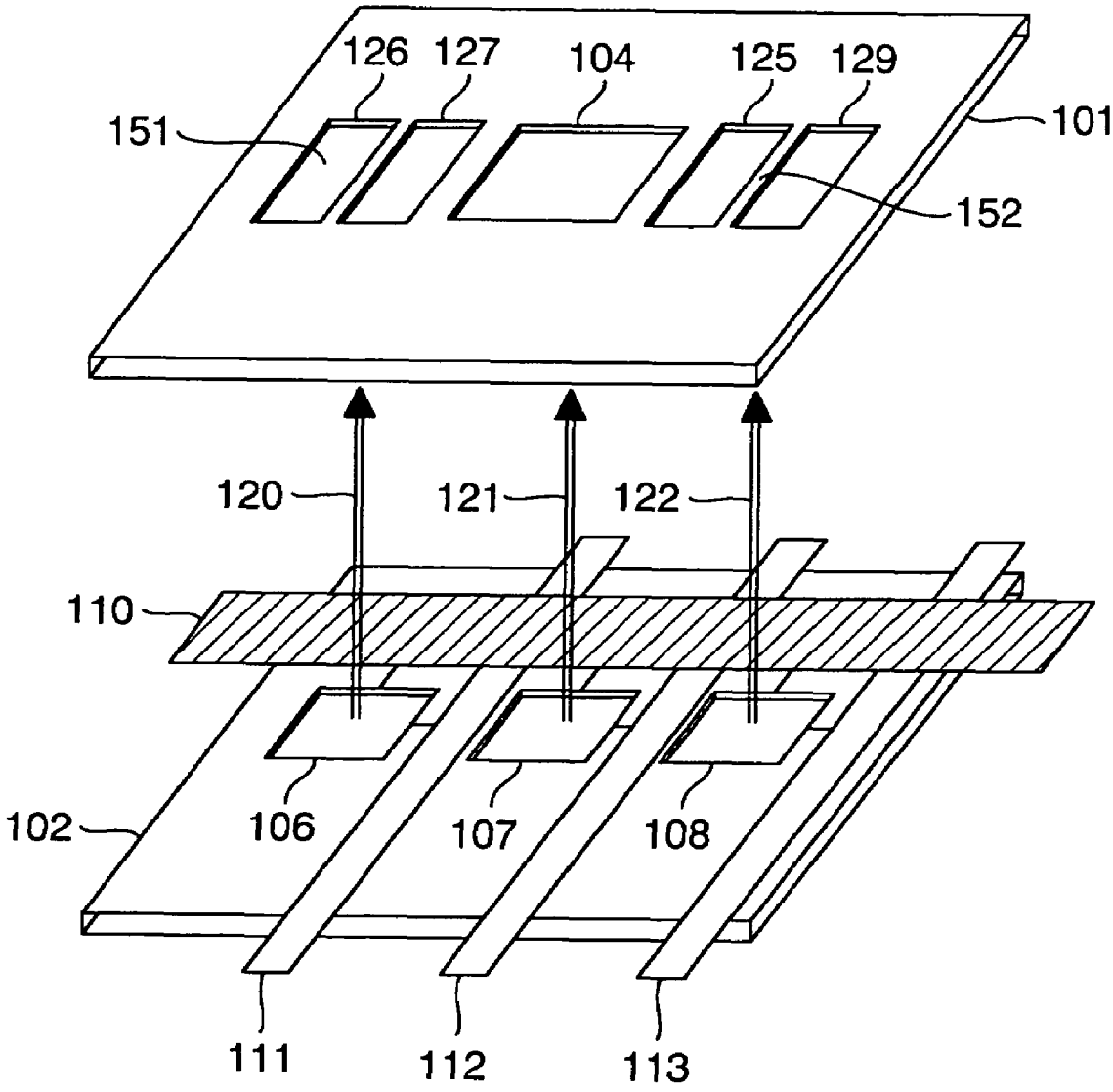
FIG. 3 is a diagram for illustratively indicating an internal structure of an FED panel according to a second embodiment of this invention.

A second embodiment according to this invention will now be described with reference to FIG. 3. It should be understood that the same reference numerals shown in FIG. 2 will be employed as those for denoting the same structural elements indicated in FIG. 3. The second embodiment is featured as follows. That is, shield portions 151 and 152 which shield a portion of light emitted from phosphors are provided at substantially center portions of regions where both red phosphors and blue phosphors are formed, and each of light emitting regions of both the red phosphors and the blue phosphors is subdivided by two. In FIG. 3, the red phosphors are indicated by reference numerals 126 and 127, whereas the blue phosphors are represented by reference numerals 128 and 129. In other words, the light emitting regions of the red phosphors are subdivided into both a region 126 and another region 127 by the shield portion 151, whereas the light emitting regions of the blue phosphors are subdivided into both a region 128 and another region 129 by the shield portion 152. In this case, an area of the region 126 is equal to an area of the region 127, and also, an area of the region 128 is equal to an area of the region 129. Further, a total area as to the regions 126 and 127 and the shield portion 151, an area of a green phosphor 104, and a total area as to the regions 128 and 129, and also, an area of the shield portion 152 are made equal to each other.

As previously explained, a portion of the light emitted from the red phosphor 123 is shield by the shield portion 151, and a portion of the light emitted from the blue phosphor 125 is shielded by the shield portion 152. As a result, both the light emitting region (namely, total area of regions 126 and 127) of the red phosphor 123, and the light emitting region (namely, total area of regions 128 and 129) of the blue phosphor 125 is made smaller than the area of the green phosphor 104. As a consequence, light emitting amounts from the red phosphor 123 and the blue phosphor 125 is reduced. In this case, when the widths of the above-described shield portions 151 and 152 are set in a proper manner, then the light emitting amounts of both the red phosphor 123 and the blue phosphor 125 are controlled. For instance, when the light emitting region (total area of regions 126 and 127) of the red phosphor 123 is approximately 0.85 times larger than the area of the green phosphor 104, and also, the area of the blue phosphor 125 is approximately 0.9 times larger than the area of the green phosphor 104, it is possible to obtain the white color having the color temperature of 9,300 K equal to the standard white color. Also, when an area of the red-phosphor 123 is approximately 0.9 times larger than an area of the green phosphor 104, and also, an area of the blue phosphor 125 is approximately 0.9 to 0.95 times larger than the area of the green phosphor 104, then such a white color having a color temperature approximated to 6,500 K is obtained.

Also, in the second embodiment, entire long edge dimensions and entire short edge dimensions as to the light emitting regions of both the red phosphor 123 and the blue phosphor 125 are made equal to a long edge dimension and a short edge dimension as to the light emitting region of the green phosphor 104. As a consequence, lowering of the light emitting intensity which is caused by positional shifts between the electron sources 106 to 108 and the RGB phosphors 123, 104, 125 are reduced, as compared with that obtained in the case that the long edge dimensions of the light emitting regions of both the red phosphor 123 and the blue phosphor 125 are shortened as explained in the first embodiment shown in FIG. 2. In other words, in the second embodiment, while an allowable range (margin) as to the positional shift amounts between the electron sources 106 to 108, and the phosphors 123, 104, 125 is increased, the light emitting intensity from the red phosphor 123 and the blue phosphor 125 is limited.

Embodiment 3

Figure 4:
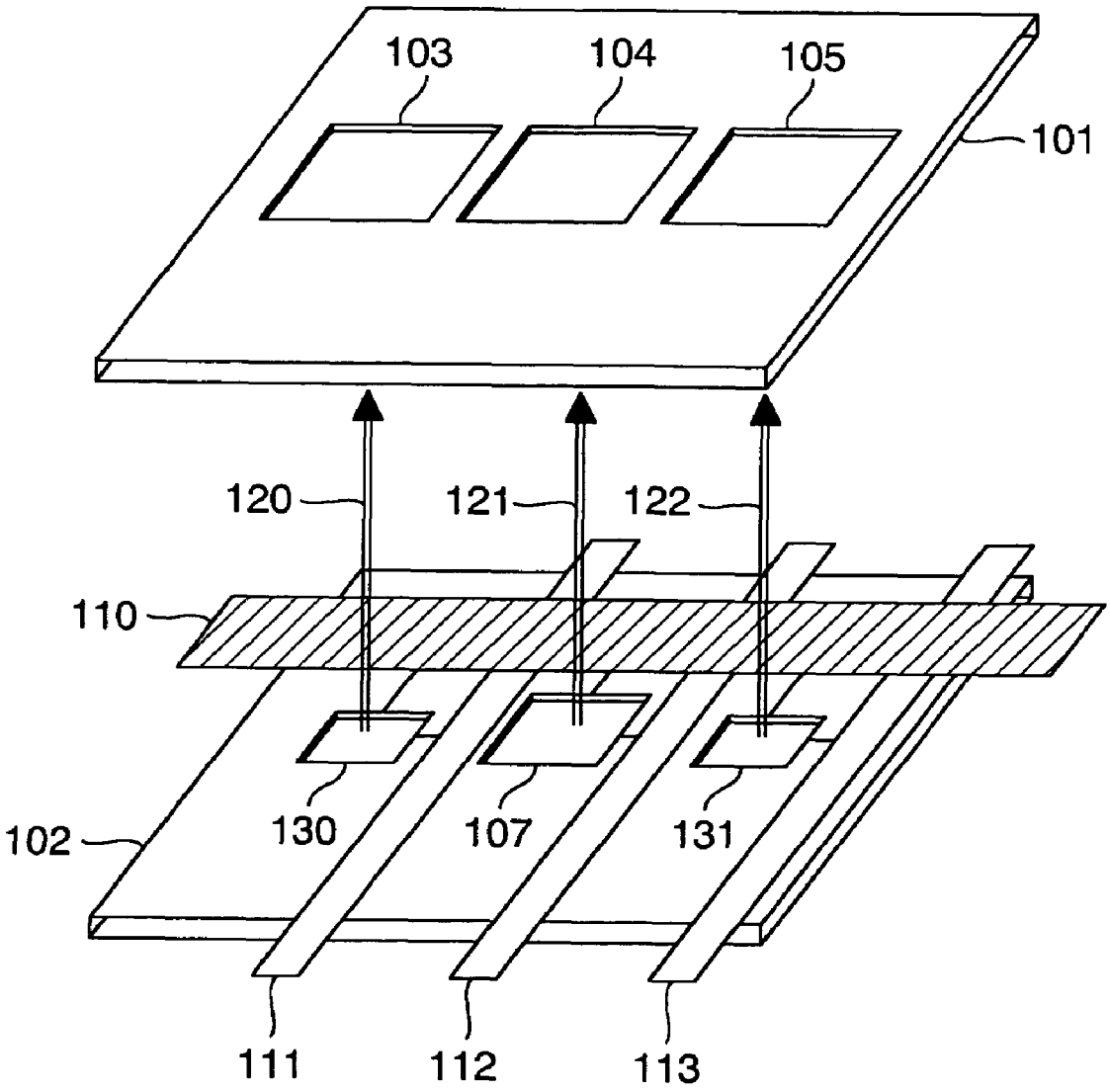
FIG. 4 is a diagram for illustratively showing an internal structure of an FED panel according to a third embodiment of this invention.

A third embodiment according to this invention will now be described with reference to FIG. 4. It should be understood that the same reference numerals shown in FIG. 2 will be employed as those for denoting the same structural elements indicated in FIG. 4. In FIG. 4, an electron source corresponding to a red phosphor 103 is expressed by reference numeral 130, and an electron source corresponding to a blue phosphor 105 is denoted by reference numeral 131. In the below-mentioned description, the electron source 130 corresponding to the red phosphor 103 will be referred to as an electron source R130; the electron source 170 corresponding to the green phosphor 104 will be referred to as an electron source G107; and also, the electron source 131 corresponding to the blue phosphor 105 will be referred to as an electron source B131.

The third embodiment is different from the first embodiment and the second embodiment, and is featured by that although areas (light emitting regions) of the respective color phosphors 103 to 105 are made equal to each other, areas of the electron sources corresponding to the respective color phosphors 103 to 105 are made different from each other. In this case, when it is so assumed that an emitting area of an electron source is "S", density of electron beams emitted form the electron source is "Je", and light emitting luminance from a phosphor is "Bph", a relationship expressed by the below-mentioned expression 1 is established:

$$Bph \propto S \cdot Je \qquad \text{(Expression 1)}$$

In other words, since the light emission luminance "Bph" of the phosphor is direct proportional to the area "S" of the electron source, in such a case that levels of drive signals supplied to the red, green, and blue electron sources are identical to each other, since the areas "S" of these electron sources are properly changed, a ratio of luminance as to the red, green, and blue phosphors can be changed. As a consequence, when the area of the electron source R130 and the area of the electron source B131 are made smaller than the area of the electron source G104, then the amounts of the electrons which are emitted from both the electron source R130 and the electron source B131 are limited, so that the light emitting amounts of these color phosphors 103, 104, 105 corresponding to the respective electron sources R130, G104, B131 can be suppressed. In the third embodiment, the area of the electronic source R130 is set to be for example, 85% to 90% with respect to the area of the electronic source G107. As a result, the light emitting amount of the red phosphor 103 is suppressed to be 85% to 90% of the light emitting amount of the green phosphor 104. Also, the area of the electronic source B131 is set to be, for example, 90% to 95% with respect to the area of the electronic source G107. As a result, the light emitting amount of the blue phosphor 105 is suppressed to be 90% to 95% of the light emitting amount of the green phosphor 104. In this case, when the area of the electron source R130 is approximately 0.85 times larger than the area of the electron source G107, and the area of the electron source R131 is approximately 0.90 times larger than the area of the electron source G107, it is possible to obtain the white color having the color temperature of 9,300 K equal to the standard white color. Also, when the area of the electron source R130 is approximately 0.9 times larger than the area of the electron source G107, and the area of the electron source B131 is approximately 0.92 to 0.95 times larger than the area of the electron source G107, then such a white color having a color temperature approximated to 6,500 K is obtained.

In order that the areas of the electron sources are changed, in such a case that electron sources correspond to MIM type electron sources, areas of insulating layers are changed which are sandwiched between the scanning line electrode 110 and the data lines 111 to 113. In other words, in order to change the areas of the electron sources, the areas of the respective insulating layers of both the electron source R130 and the electron source B131 are made smaller than the area of the insulating layer of the electron source G107. Further, even when the area of the scanning line electrode 110 is changed which is connected to both the electron source R130 and the electron source B131, the areas of the electron sources are changed.

As previously explained, also, in accordance with the third embodiment, it is possible to prevent the deterioration of the white balance due to the difference in the light emission luminance characteristics of the respective RGB phosphors 103, 104, 105. Furthermore, even when the driving voltages having the substantially same levels are applied to the electronic sources R130, G107, and B131 corresponding to the RGB phosphors 103, 104, and 105, both the white color having the high color temperature and the superior white balance are obtained.

Embodiment 4

Figure 5:
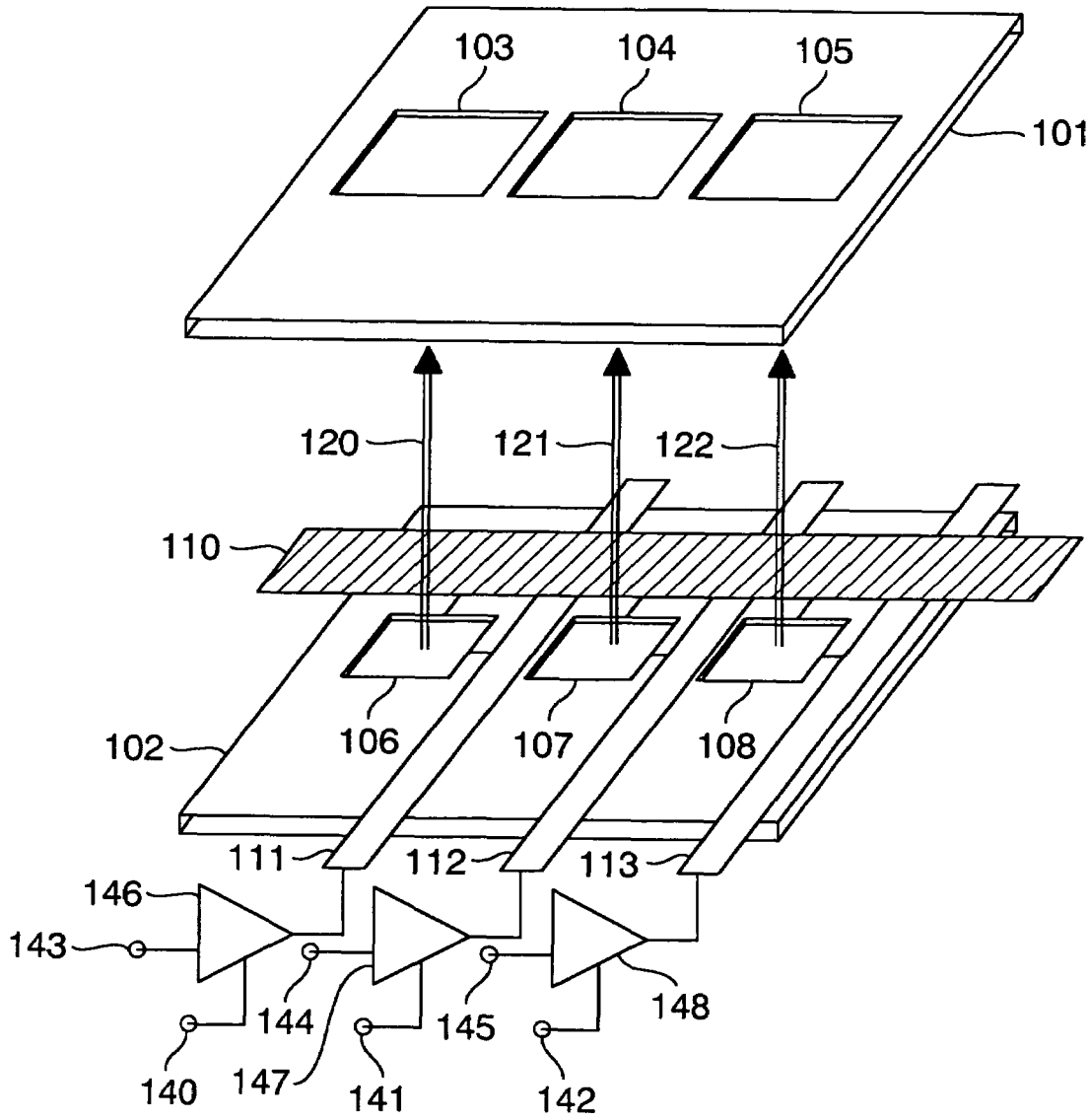
FIG. 5 is a diagram for illustratively indicating an internal structure of an FED panel according to a fourth embodiment of this invention.

A fourth embodiment according to this invention will now be described with reference to FIG. 5. It should be understood that the same reference numerals shown in FIG. 2, or FIG. 4 will be employed as those for denoting the same structural elements indicated in FIG. 5. The fourth embodiment is featured by that although areas of the respective color phosphors 103 to 105 are made equal to each other and areas of the respective electron sources 106 to 108 are similarly made equal to each other, gains of respective drive signals supplied to the data lines 111 to 113 are controlled by variable gain amplifiers 146 to 148, so that these gains of the respective drive signals are made different from each other.

The variable gain amplifiers 146, 147 and 148 are coupled to a data line 111 which is connected to the electron source 106 corresponding to the red phosphor 103, a data line 112 which is connected to the electron source 107 corresponding to the green phosphor 104, and a data line 113 which is connected to the electron source 106 corresponding to the blue phosphor 105. Also, the variable gain amplifiers 146 to 148 are built in the data drivers 4 to 6, and are equipped with input terminals 143 to 145 for drive signals, and gain setting terminals 140 to 142 of a drive circuit. Then, the variable gain amplifiers 146 to 148 amplify the drive signals entered to the input terminals 143 to 145 in correspondence with the gains entered to the gain setting terminals 140 to 142, respectively. The gain setting terminals 140 to 142 are conducted to the external units of the data drivers 4 to 6, and are connected to voltage sources having predetermined levels. In the below-mentioned description, the variable gain amplifier 146 is referred to as a variable gain amplifier R146 functioning as a red-purpose amplifier; the variable gain amplifier 147 is referred to as a variable gain amplifier G147 functioning as a green-purpose amplifier; and also, the variable gain amplifier 148 is referred to as a variable gain amplifier B148 functioning as a blue-purpose amplifier.

Assuming now that the gain entered to the gain setting terminal 141 of the variable gain amplifier G147 is equal to 1, the gain of the variable gain amplifier R146 is set to 0.85 to 0.90, and the gain of the variable gain amplifier B148 is set to 0.90 to 0.95. That is to say, a level of a voltage source which is connected to the gain setting terminal 140 is 0.85 to 0.90 times higher than a level of a voltage source which is connected to the gain setting terminal 141, and a level of a voltage source which is connected to the gain setting terminal 142 is 0.90 to 0.95 times higher than a level of a voltage source which is connected to the gain setting terminal 141. As a result, a light emission amount of the red phosphor 103 is suppressed to 85% to 90% of a light emission amount of the green phosphor 104. Similarly, a light emission amount of the blue phosphor 105 is suppressed to 90% to 95% of a light emission amount of the green phosphor 104. In this case, when the gain of the variable gain amplifier R146 is approximately 0.85 and the gain of the variable gain amplifier B148 is approximately 0.90, then such a white color is obtained which owns the color temperature of 9,300 K corresponding to the standard white color. Also, when the gain of the variable gain amplifier R146 is approximately 0.9, and the gain of the variable gain amplifier B148 is approximately 0.92 to 0.95, then such a white color approximated to 6,500 K is obtained.

As previously described, in accordance with the fourth embodiment, in such a case that the amplitude of the red signal, the amplitude of the green signal, and the amplitude of the blue signal are identical to each other, the standard white color is obtained, so that the amplitude adjustment every color need not be carried out in the video signal processing block 12. As a result, a picture display having a high image quality without any gradation drop is realized.

The above-explained embodiments have explained such an exemplification that the light emission intensity of the green phosphor is made higher than the light emission intensity of both the red phosphor and the blue phosphor. However, the light emission intensity of the green phosphor is alternatively made higher than any one of the light emission intensity of both the red phosphor and the blue phosphor. For instance, in such a case that there is not so large difference between the light emission intensity of the green phosphor and the light emission intensity of the blue phosphor, the areas of both the red phosphor and the blue phosphor are alternatively equal to each other, and further, these areas are alternatively larger than the area of the red phosphor. Also, in the case that a color temperature higher than 9,300 K is wanted to be obtained, the areas of these color phosphors are arranged in a similar manner. In the above-explained respective embodiments, such an example has been explained in which the MIM type electron emitter elements (cathodes) are employed as the electron emitter elements. Alternatively, as apparent from the foregoing description, this invention may be applied to such an example that other electron emitter elements (for instance, carbon nano-tube type electron emitter element, surface propagation type electron emitter element, etc.) than the MIM type electron emitter element are used.

It should be further understood by those skilled in the art that although the foregoing description has been made on embodiments of the invention, the invention is not limited thereto and various changes and modifications may be made without departing from the spirit of the invention and the scope of the appended claims.

The invention claimed is:

1. A field emission display apparatus comprising:

a first substrate including a plurality of electron emitter elements; and a second substrate which is arranged opposite to said first substrate, and includes three sets of red, green, blue phosphors, said three color phosphors being excited by electrons emitted from said plurality of electron emitter elements so as to emit light;

wherein both a light emission intensity of said red phosphor and a light emission intensity of said blue phosphor is higher than a light emission intensity of said green phosphor, and an area of said blue phosphor and said red phosphor each is smaller than an area of said green phosphor.

2. A display apparatus as claimed in claim 1, further comprising:

a data drive circuit which produces a drive signal based upon an inputted picture signal; and a scan drive circuit which produces a selection signal; wherein:

said first substrate includes: a plurality of data lines to which the drive signal derived from said data drive circuit is applied; a plurality of scanning electrode lines to which the selection signal derived from said scan drive circuit is applied and which is arrayed in such a manner that said scanning electrode lines are intersected perpendicular to said data lines; and said plurality of electron emission elements which are provided at intersecting portions between said data lines and said scanning electrode lines, and emit the electrons in response to a potential difference between said drive signal and said selection signal.

3. A display apparatus as claimed in claim 2 wherein:

while said red phosphor, said green phosphor, and said blue phosphor own rectangular shapes, long edge dimensions of said red phosphor and said blue phosphor are made shorter than a long edge dimension of said green phosphor.

4. A display apparatus as claimed in claim 2 wherein:

a shield portion is formed at a substantially center portion of a region where either said red phosphor or said blue phosphor is formed, while said shield portion shields a portion of light emitted from said red phosphor, or said blue phosphor.

5. A display apparatus as claimed in claim 4 wherein:

either said red phosphor or said blue phosphor is subdivided by said shield portion.

6. A display apparatus as claimed in claim 2 wherein:

an area of said red phosphor is 0.85 to 0.9 times larger than an area of said green phosphor.

7. A display apparatus as claimed in claim 2 wherein:

an area of said blue phosphor is 0.9 to 0.95 times larger than an area of said green phosphor.

8. A display apparatus as claimed in claim 1 wherein:

a shield portion is formed at a substantially center portion of a region where either at least one of said red phosphor and said blue phosphor is formed, while said shield portion shields a portion of light emitted from said red, or blue phosphor.

9. A display apparatus as claimed in claim 8 wherein:

said shield portion is provided in a region where either said red phosphor or said blue phosphor among said red phosphor, green phosphor, and blue phosphor is formed.

10. A field emission display apparatus comprising:

a data drive circuit for producing a drive signal based upon an input picture signal;

a scan drive circuit for producing a selection signal;

a first substrate which includes a plurality of data lines to which the drive signal derived from said data drive circuit is applied, a plurality of scanning electrode lines to which the selection signal derived from said scan drive circuit is applied and which is arrayed in such a manner that said scanning electrode lines are intersected perpendicular to said data lines, and a plurality of electron emitter elements which are provided at intersecting portions between said data lines and said scanning electrode lines, and emit the electrons in response to a potential difference between said drive signal and said selection signal; and a second substrate where three sets of red, green, blue phosphors which are excited by electrons emitted from said electron emitter elements so as to emit light are arranged, said second substrate transmitting therethrough light emitted from said three color phosphors so as to form a picture on a plane located opposite to the arranging plane of said three color phosphors;

wherein both a light emission intensity of said red phosphor and a light emission intensity of said blue phosphor are higher than a light emission intensity of said green phosphor, and an area of the electron emitter element which corresponds to said red phosphor and said blue phosphor each is smaller than an area of the electron emitter element which corresponds to said green phosphor.

11. A display apparatus as claimed in claim 10 wherein:

an area of the electron emitter element which corresponds to said blue phosphor is 0.9 to 0.95 times larger than an area of the electron emitter element which corresponds to said green phosphor.

12. A display apparatus as claimed in claim 10 wherein:

said electron emitter element corresponds to an MIM (Metal Insulator Metal) type electron emitter element.

13. A display apparatus as claimed in claim 10 wherein:

shapes of said electron emitter elements are rectangular shapes; and long edge dimensions of the electron emitter elements which correspond to both said red phosphor and said blue phosphor are made shorter than a long edge dimension of the electron emitter element which corresponds to said green phosphor.

14. A display apparatus as claimed in claim 10 wherein:

an area of the electron emitter element which corresponds to said red phosphor is 0.85 to 0.9 times larger than an area of the electron emitter element which corresponds to said green phosphor.

15. A display apparatus comprising:

a data drive circuit for producing a drive signal based upon an inputted picture signal;

a scan drive circuit for producing a selection signal;

a first substrate which includes a plurality of data lines to which the drive signal derived from said data drive circuit is applied, a plurality of scanning electrode lines to which the selection signal derived from said scan drive circuit is applied and which is arrayed in such a manner that said scanning electrode lines are intersected perpendicular to said data lines, and a plurality of electron emitter elements which are provided at intersecting portions between said data lines and said scanning electrode lines, and emit the electrons in response to a potential difference between said drive signal and said selection signal; and a second substrate where three sets of red, green, blue phosphors which are excited by electrons emitted from said electron emitter elements so as to emit light are arranged, said second substrate transmitting therethrough light emitted from said three color phosphors so as to form a picture on a plane located opposite to the arranging plane of said three color phosphors; wherein:

a gain of the drive signal which is supplied to the electron emitter element corresponding to either said red phosphor or said blue phosphor is lower than a gain of the drive signal which is supplied to the electron emitter element corresponding to said green phosphor.

* * * * *